United States Patent [19]

Eddy et al.

[11] 4,048,836

[45] Sept. 20, 1977

[54] FORMING AND HEAT TREATING PROCESS

[75] Inventors: Robert A. Eddy; Norman F. Gustafson, both of Westboro; Stephen J. Erwin, North Grafton, all of Mass.

[73] Assignee: Wyman-Gordon Company, Worcester, Mass.

[21] Appl. No.: 718,050

[22] Filed: Aug. 26, 1976

Related U.S. Application Data

[63] Continuation of Ser. No. 293,092, Sept. 28, 1972, abandoned, which is a continuation of Ser. No. 41,947, June 1, 1970, abandoned.

[51] Int. Cl.[2] ..... B21J 1/06

[52] U.S. Cl. ..... 72/364; 148/11.5 A

[58] Field of Search ..... 148/11.5, 125; 72/342, 72/364

[56] References Cited

U.S. PATENT DOCUMENTS

| | | | |
|---|---|---|---|
| 3,185,600 | 5/1965 | Dullberg | 148/125 |
| 3,392,568 | 7/1968 | Garrity | 148/11.5 A |
| 3,568,491 | 3/1971 | Bruner et al. | 148/11.5 A |

OTHER PUBLICATIONS

Metals Handbook, American Society for Metals, 8th Ed., vol. 2, 1964, pp. 615, 616, 619, 620.

Metals Handbook, American Society for Metals, 8th Ed., vol. 5, 1970, pp. 128–131.

*Primary Examiner*—Lowell A. Larson

*Attorney, Agent, or Firm*—Norman S. Blodgett; Gerry A. Blodgett

[57] ABSTRACT

This invention relates to a forming and heat treating process and, more particularly, a process for forging and heat treating an aluminum alloy article wherein the article is quickly cooled after solution heat treating to terminate aging and to cause shrinkage and then is subjected to a re-striking operation to produce stress relieving.

3 Claims, 1 Drawing Figure

ROBERT A. EDDY
NORMAN F. GUSTAFSON
STEPHEN J. ERWIN
INVENTORS.

BY

Norman S. Blodgett

FORMING AND HEAT TREATING PROCESS

BACKGROUND OF THE INVENTION

It is common practice to form high strength aircraft structural components by forging the article from an aluminum alloy and then subjecting the forging to a machining operation to bring it to finish size. A typical element formed in this manner might have transverse flanges of fairly heavy cross-section joined by webs of substantially smaller cross-section. When such articles are forged by conventional forging processes it is very likely that the finished forging will contain internal stresses due to cooling from the solution treating temperature. When machining takes place, these stresses produce such phenomena as "oil canning" in the web joining the flanges and overall warpage of the article. This is an intolerable situation because it renders the article unusable and yet may not make its appearance until the last stages of an expensive series of operations on an expensive article. These and other difficulties experienced with the prior art devices have been obviated in a novel manner by the present invention.

It is, therefore, an outstanding object of the invention to provide a forming and heat treating process for aluminum alloy which relieves internal stresses.

Another object of this invention is the provision of a process for forming and heat treating an aluminum alloy article which, when machined, will not suffer from distortion and warping or the like, which would render the article unusable.

A further object of the present invention is the provision of a process for forming and heat treating an aluminum alloy in which a stress relieving restriking operation can take place before aging occurs in the forging.

With these and other objects in view, as will be apparent to those skilled in the art, the invention resides in the combination of steps set forth in the specification and covered by the claims appended hereto.

SUMMARY OF THE INVENTION

In general, the invention consists of a process for forming and heat treating an aluminum alloy article, comprising the steps of finish forging the article in a set of dies, solution heat treating the article, immediately cooling the article in warm water, immediately removing the article from the water and sub-cooling it to a temperature around -100° F., and restriking the article.

More specifically, the article is subjected to a step of black etching between finish forging and heat treating, and the article is subjected to a cooling step between the cooling in warm water and the sub-cooling, the step consisting of washing the article in water at room temperature and immediately packing it in dry ice.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
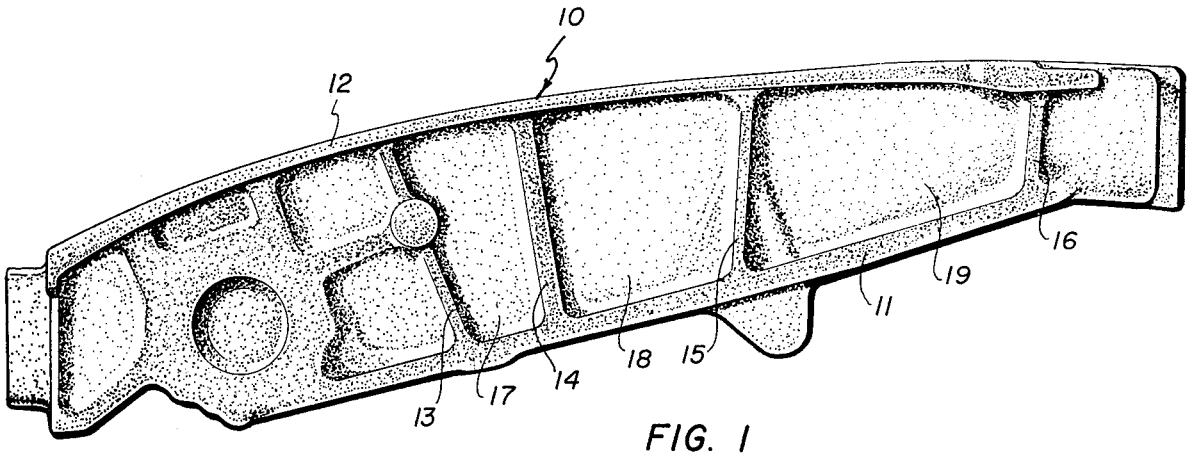
FIG. 1 is an elevational view of a typical forging manufactured in accordance with the process of the present invention, an FIG. 2 is a flow chart showing the arrangement of the steps of the process.

Referring to FIG. 1, it can be seen that the forged article, indicated generally by the reference numeral 10, is a rib of an aircraft before machining and is formed from an aluminum alloy known as Type 7075. As is evident in the drawing, the rib is provided with a flange 11 along the lower surface, a flange 12 along its upper surface, and transverse flanges 13, 14, 15, and 16 extending transversely across the member between the flanges 11 and 12. The flanges 13 and 14 combine with the flanges 11 and 12 to form a four-sided polygon, and between the flanges in this area extends a web 17. Similarly, a web 18 extends between the flanges 14, 15, 11, and 12, while a similar web 19 extends between the flanges 15, 16, 11 and 12. It can be seen that the flanges 11, 12, 13, 14, 15, and 16 are quite heavy in cross-section and provide the structural strength for the aircraft rib. The webs 17, 18, and 19, however, are quite thin in cross-section and, during the final machining operation on the article, may become as thin as 0.045. It is this area in particular in the article that has caused the difficulty in the past of "oil canning". Other forms of deformation of the finished article, such as warpage, have also historically been a problem.

Figure 2:
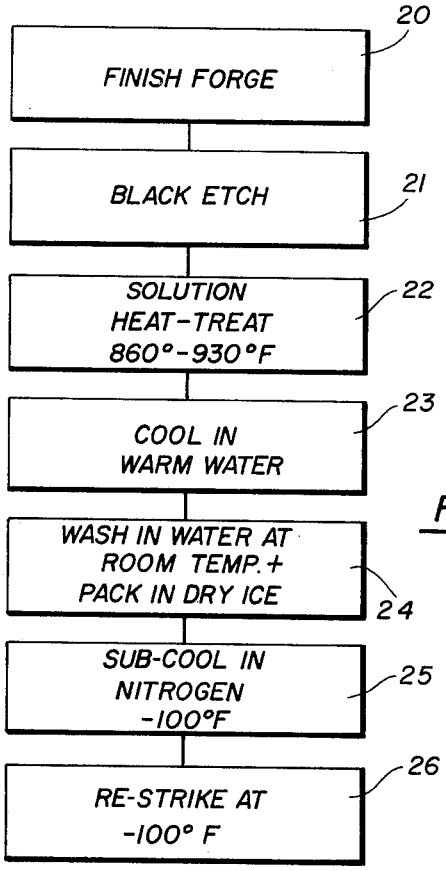

In FIG. 2 is shown a flow diagram of a process for forming and heat treating the aircraft rib 10 in such a way as to prevent deformation and the inclusion of residual stresses throughout the unmachined forging. The first step 20 of the process consists in finish forging the article in a set of dies. These dies are formed to give the forging its final shape. The second step 21 consists of subjecting the article to a step of black etching. This is brought about by immersing the article 10 in a solution of sodium hydroxide and then washing it in water. It provides the forging with a dense black finish.

The third step 22 consists in solution heat treating the article at a temperature in the range from 830° F. to 930° F.

The fourth step 23 consists in removing the article from the heat treating furnace and immediately cooling the article in warm water at a temperature around 155° F.

The fifth step 24 consists in removing the article from the warm water as soon as it has reached the water temperature, washing the article in water at room temperature, and packing it in dry ice.

The sixth step 25 consists in sub-cooling the article to a temperature of −100° F. by immersing it in a nitrogen atmosphere at that temperature.

The seventh step 26 consists of restriking the article in the same finish dies as were used in connection with the first step 20 or in a special set of dies designed for that purpose. The restriking takes place with the article at substantially the same temperature as the sub-cooling temperature, that is to say, around −100° F. In the preferred embodiment of the invention, the article is placed in a nitrogen atmosphere at −100° F. to prevent aging, so that it can be checked for size, etc. If necessary, then, it can be reworked before being allowed to return to room temperature. Under some conditions, the article may be allowed to age at a temperature in the range from 225° F. to 375° F. before being allowed to return to room temperature.

It should be pointed out that this process can be used in connection with other aluminum alloys, such as Type 2014 and 7079. The quenching in warm water (that is to say, the fourth step 23) can take place at a temperature in the range from 140° F. to 180° F. It is important that the fourth step 23, the fifth step 24, and the sixth step 25 take place with a minimum of time between them.

EXAMPLE

In a commercial embodiment of the invention, an aluminum alloy forging of the type known as 7075 was processed in accordance with the present invention. The minimum chemistry in a large batch of such workpieces was 1.2% copper, 0.18% chromium, 5.1% zinc, and 2.1% magnesium. The maximum chemistry allowable in the batch was 2.0% copper, 0.30% manganese, 0.70% iron, 0.50% silicon, 0.40% chromium, 6.1% zinc, 0.20% titanium, and 2.9% magnesium, the balance in all cases being, of course, aluminum. The workpiece was finished forged and subjected to a black etch in sodium hydroxide solution. The workpiece was then solution heat treated at a temperature in the range from 830° F. to 930° F. It was then cooled in warm water at 155° F. removed from the water as soon as the article reached water temperature, washed in water at room temperature, and packed in dry ice. It was then subjected to a sub-cooling in nitrogen to −100° F. The three steps of cooling in warm water, washing in water at room temperature, and packing in dry ice and sub-cooling in nitrogen to −100° F. took place in rapid succession. It was then subjected to a coining or restriking at the −100° F. temperature, and aged to a T-652 temper, this being a metallurgical specification of heat treating hardness. The forgings were ultrasonically inspected and met the requirements of the Boeing Aircraft Corporation's specification BAC5439E Class A and B, so far as internal discontinuities were concerned. Brinell hardness range for the forging was 165 to 177. This workpiece was finish machined with no sign of oil canning or other forms of distortion. It was obvious that distortion did not take place because the residual stresses had been substantially reduced by the process.

It is obvious that minor changes may be made in the form and construction of the invention without departing from the material spirit thereof. It is not, however, desired to confine the invention to the exact form herein shown and described, but it is desired to include all such as properly come within the scope claimed:

The invention having been thus described, what is claimed as new and desired to secure by Letters Patent is:

1. A process for forming and heat treating an aluminum alloy article, comprising the steps of:

a. forging the article in a set of finish dies,
b. black etching the article,
c. solution heat treating the article at a temperature in the range from 830° F. to 930° F.,
d. immediately cooling the article in warm water at a temperature in the range from 140° F. to 180° F., and removing it as soon as it reaches water temperature,
e. immediately cooling the article in water at room temperature,
f. immediately packing the article in dry ice,
g. sub-cooling the article in nitrogen to −100° F., and
h. restriking the article in the said finish dies, the article being stored after restriking in a nitrogen atmosphere at −100° F., being checked for configuration, and being reworked if necessary before being allowed to return to room temperature.

2. A process as recited in claim 1, wherein the restriking takes place with the article at substantially the same temperature as the sub-cooling.

3. A process as recited in claim 1, wherein the black etching takes place by immersing the article in a solution of sodium hydroxide and then washing it in water.

* * * * *